US008961115B2

(12) United States Patent
Rhoden et al.

(10) Patent No.: US 8,961,115 B2
(45) Date of Patent: Feb. 24, 2015

(54) CLEARANCE CONTROL FOR GAS TURBINE ENGINE SEAL

(75) Inventors: William E. Rhoden, Glastonbury, CT (US); Peter L. Jalbert, Granby, CT (US)

(73) Assignee: United Technologies Corporation, Hartford, CT (US)

( * ) Notice: Subject to any disclaimer, the term of this patent is extended or adjusted under 35 U.S.C. 154(b) by 489 days.

(21) Appl. No.: 13/552,689

(22) Filed: Jul. 19, 2012

(65) Prior Publication Data

US 2014/0020390 A1 Jan. 23, 2014

(51) Int. Cl.
*F01D 11/22* (2006.01)

(52) U.S. Cl.
CPC ..... *F01D 11/22* (2013.01)
USPC ..... 415/173.2; 60/726; 415/173.1; 415/173.3

(58) Field of Classification Search
CPC ..... F01D 11/16; F01D 11/22
USPC ..... 415/173.1–173.3
See application file for complete search history.

(56) References Cited

U.S. PATENT DOCUMENTS

| | | | | |
|---|---|---|---|---|
| 3,227,418 | A * | 1/1966 | West | 415/127 |
| 4,087,199 | A | 5/1978 | Hemsworth et al. | |
| 4,384,819 | A * | 5/1983 | Baker | 415/14 |
| 4,462,264 | A | 7/1984 | Feller | |
| 5,012,420 | A | 4/1991 | Walker et al. | |
| 5,370,340 | A | 12/1994 | Pla | |
| 5,456,576 | A | 10/1995 | Lyon | |
| 5,545,007 | A | 8/1996 | Martin | |
| 6,290,458 | B1 * | 9/2001 | Irie et al. | 415/119 |
| 6,363,581 | B1 * | 4/2002 | Zipp | 24/19 |
| 6,368,054 | B1 | 4/2002 | Lucas | |
| 7,079,957 | B2 * | 7/2006 | Finnigan et al. | 702/33 |
| 2004/0140737 | A1 * | 7/2004 | Barillot et al. | 310/328 |
| 2008/0267770 | A1 | 10/2008 | Webster et al. | |
| 2011/0293407 | A1 * | 12/2011 | Wagner | 415/170.1 |
| 2012/0156007 | A1 | 6/2012 | Bacic | |

FOREIGN PATENT DOCUMENTS

JP 2002285803 A 10/2002

OTHER PUBLICATIONS

Taiho Yeom et al., Jan. 2, 2012, High frequency, large displacement, and low power consumption piezoelectric translational actuator based on an oval loop, from Sensors and Actuators Journal.*

(Continued)

*Primary Examiner* — Phutthiwat Wongwian
*Assistant Examiner* — Rene Ford
(74) *Attorney, Agent, or Firm* — Carlson, Gaskey & Olds, PC

(57) ABSTRACT

A gas turbine engine section has a rotor carrying a plurality of blades. The blades have airfoils which define a radially outer tip. A blade outer air seal is positioned radially outwardly of the tips of the blades. The blade outer air seal is provided by at least a plurality of circumferentially spaced segments, which slide circumferentially relative to each other to adjust an inner diameter of an inner surface of the blade outer air seal segments. An actuator actuates the blade outer air seal segments to slide towards each other to control a clearance between the inner periphery of the blade outer air seal segments and the radially outer tip of the blade airfoils. A gas turbine engine is also disclosed.

18 Claims, 3 Drawing Sheets

(56) References Cited

OTHER PUBLICATIONS

F. Claeyssen et al., Apr. 2003, Smart Actuators for Aircraft applications, from FLUX Magazine.*

International Search Report and Written Opinion for International Application No. PCT/US2013/050621 completed on Oct. 14, 2013.

* cited by examiner

CLEARANCE CONTROL FOR GAS TURBINE ENGINE SEAL

BACKGROUND OF THE INVENTION

This application relates to a piezoelectric control for the clearance between a radially outer seal, and radially inner rotating blades in a gas turbine engine.

Gas turbine engines are known, and typically include a compressor section compressing air with a plurality of rotors each carrying blades. Vanes are positioned between stages of the blades. The air is compressed by the compressor and delivered into a combustion section in which it is mixed with fuel and ignited. Products of this combustion pass downstream over turbine rotors, driving them to rotate. The turbine rotors also carry blades, and have intermediate vanes.

It is known to provide a seal radially outwardly of the blades in both the compressor and turbine sections. These seals function to cause the great bulk of the gas to flow across the blades, thus increasing the efficiency of the system.

However, the clearance between the outer periphery of the blades and the inner periphery of the seals can vary for any number of reasons.

It is known to provide sensors for measuring an amount of clearance, however, to date there has been no practical manner for adjusting the location of the seal should the clearance be undesirably high.

SUMMARY OF THE INVENTION

In a featured embodiment, a gas turbine engine section has a rotor carrying a plurality of blades each having a radially outer tip. A blade outer air seal is positioned radially outwardly of the tips of the blades, which are provided by at least a plurality of circumferentially spaced segments. The segments are operable to slide circumferentially relative to each other to adjust an inner diameter of an inner surface of the blade outer air seal segments. An actuator actuates the blade outer air seal segments to slide relative to each other to control a clearance between the inner periphery of the blade outer air seal segments and an outer periphery of the tips.

In another embodiment according to the previous embodiment, there are at least four blade outer air seal segments.

In another embodiment according to any of the previous embodiments, a sensor senses the amount of clearance between the inner periphery of the blade outer air seal segments and the outer periphery of a tip, and communicates to a control for the actuator to control the clearance.

In another embodiment according to any of the previous embodiments, the blade outer air seal segments have a tongue at one circumferential end and a groove at an opposed circumferential end. The tongue of one of the blade outer air seal segments fits into the groove in an adjacent one of the blade outer air seal segments to guide the blade outer air seal segments for sliding movement.

In another embodiment according to any of the previous embodiments, the actuator includes a piezoelectric stack.

In another embodiment according to any of the previous embodiments, the piezoelectric stack expands or contracts along an axis generally parallel to a rotational axis of the rotor to in turn cause the blade outer air seal segments to slide circumferentially.

In another embodiment according to any of the previous embodiments, a housing for the piezoelectric stack includes segments fixed to each of an adjacent pair of blade outer air seal segments, such that when the piezoelectric stack expands or contracts, it changes a circumferential distance between anchor points between the housing and each of the blade outer air seal segments to in turn cause the sliding movement of the blade outer air seal segments.

In another embodiment according to any of the previous embodiments, the actuator expands or contracts along an axis generally parallel to a rotational axis of the rotor to in turn cause the blade outer air seal segments to slide circumferentially.

In another embodiment according to any of the previous embodiments, a housing for the actuator includes segments fixed to each of an adjacent pair of blade outer air seal segments, such that when the actuator expands or contracts, it changes a circumferential distance between anchor points between the housing and each of the blade outer air seal segments to in turn cause the sliding movement of the blade outer air seal segments.

In another embodiment according to any of the previous embodiments, the rotor is a compressor rotor.

In another embodiment according to any of the previous embodiments, the rotor is a turbine rotor.

In another featured embodiment, a gas turbine engine has a compressor section, a combustor section, a turbine section, an actuator, and a blade outer air seal. At least one of the compressor and turbine sections includes at least one rotor carrying a plurality of blades. The blades each have airfoils defining a radially outer tip. The blade outer air seal is positioned radially outwardly of the tips of the blades. The blade outer air seal is provided by at least a plurality of circumferentially spaced segments, operable to slide circumferentially relative to each other to adjust an inner diameter of an inner surface of the blade outer air seal segments. The actuator is configured to actuate the blade outer air seal segments to slide relative to each other to control a clearance between the inner periphery of the blade outer air seal segments and an outer periphery of the tips.

In another embodiment according to the previous embodiment, a sensor senses the amount of clearance between the inner periphery of the blade outer air seal segments and the outer periphery of a tip, and communicates to a control for the actuator to control the clearance.

In another embodiment according to any of the previous embodiments, the blade outer air seal segments have a tongue at one circumferential end and a groove at an opposed circumferential end. The tongue of one of the blade outer air seal segments fits into the groove in an adjacent one of the blade outer air seal segments to guide the blade outer air seal segments for sliding movement.

In another embodiment according to any of the previous embodiments, the actuator includes a piezoelectric stack.

In another embodiment according to any of the previous embodiments, the piezoelectric stack expands or contracts along an axis generally parallel to a rotational axis of the rotor to in turn cause the blade outer air seal segments to slide circumferentially.

In another embodiment according to any of the previous embodiments, a housing for the piezoelectric stack includes segments fixed to each of an adjacent pair of blade outer air seal segments, such that when the piezoelectric stack expands or contracts, it changes a circumferential distance between anchor points between the housing and each of the blade outer air seal segments to in turn cause the sliding movement of the blade outer air seal segments.

In another embodiment according to any of the previous embodiments, the actuator expands or contracts along an axis generally parallel to a rotational axis of the rotor to in turn cause the blade outer air seal segments to slide circumferentially, and wherein a housing for the actuator includes segments fixed to each of an adjacent pair of blade outer air seal segments, such that when the actuator expands or contracts, it changes a circumferential distance between anchor points between the housing and each of the blade outer air seal segments to in turn cause the sliding movement of the blade outer air seal segments.

In another embodiment according to any of the previous embodiments, the rotor is a compressor rotor.

In another embodiment according to any of the previous embodiments, the rotor is a turbine rotor.

These and other features of this application will be best understood from the following specification and drawings, the following of which is a brief description.

DETAILED DESCRIPTION

Figure 1:
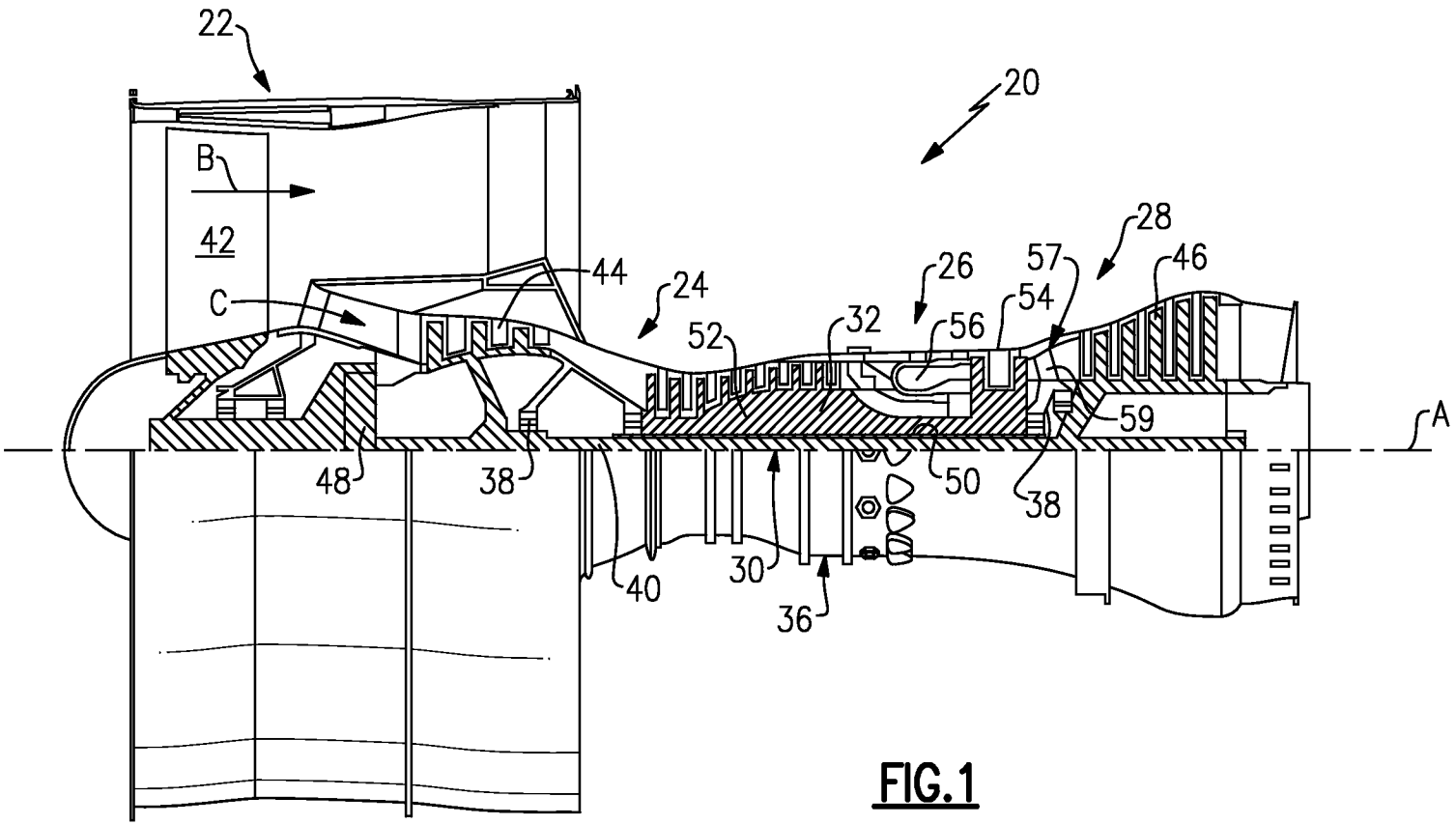
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low-pressure compressor 44 and a low-pressure turbine 46. The inner shaft 40 is connected to the fan 42 through a geared architecture 48 to drive the fan 42 at a lower speed than the low speed spool 30. The high-speed spool 32 includes an outer shaft 50 that interconnects a high-pressure compressor 52 and high-pressure turbine 54. A combustor 56 is arranged between the high-pressure compressor 52 and the high-pressure turbine 54. A mid-turbine frame 57 of the engine static structure 36 is arranged generally between the high-pressure turbine 54 and the low-pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low-pressure compressor 44 then the high-pressure compressor 52, mixed and burned with fuel in the combustor 56, then expanded over the high-pressure turbine 54 and low-pressure turbine 46. The mid-turbine frame 57 includes airfoils 59 which are in the core airflow path. The turbines 46, 54 rotationally drive the respective low speed spool 30 and high-speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3, and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low-pressure turbine 46 pressure ratio is pressure measured prior to inlet of low-pressure turbine 46 as related to the pressure at the outlet of the low-pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2:
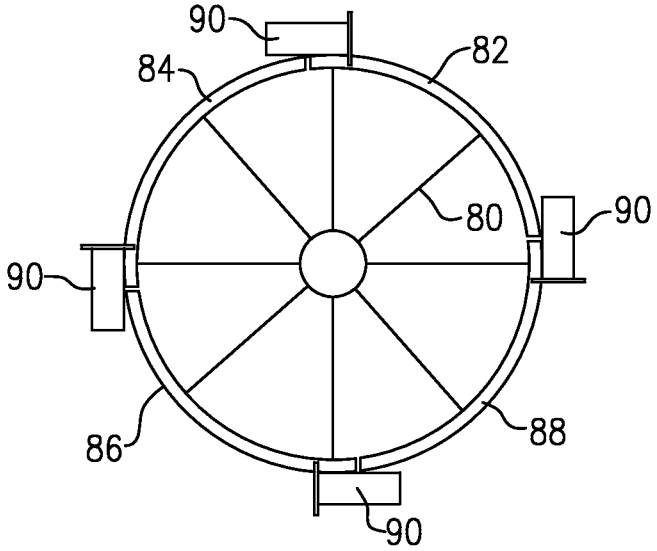
FIG. 2 schematically shows a rotor and seal combination.

FIG. 2 shows a seal arrangement provided by a plurality of circumferentially spaced seal segments 82, 84, 86 and 88. While four segments are shown, other numbers may be utilized.

As seen, the seals segments 82, 84, 86 and 88 are positioned radially outwardly of rotating blades 80. The structure shown in FIG. 2 could be part of a compressor, or could be found in the turbine section of the gas turbine engine shown in FIG. 1.

A plurality of actuators 90 are associated with the circumferential extents of the seal segments 82, 84, 86 and 88. As shown, actuators 90 bridge each adjacent pair of segments 82, 84, 86, and 88.

Figure 3:
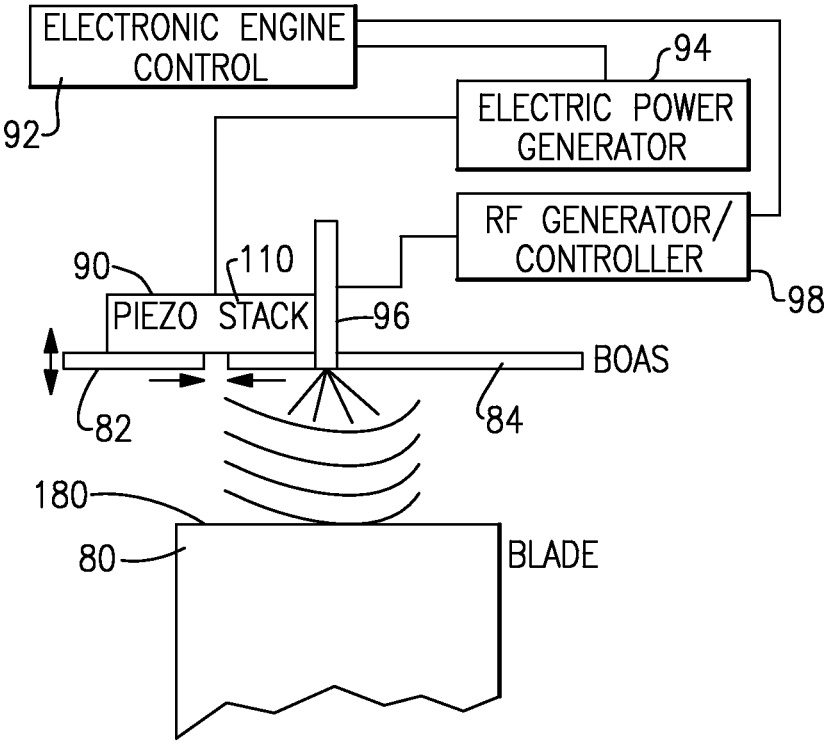
FIG. 3 is a side view of the portion of the FIG. 2 combination.

As shown in FIG. 3, the actuator 90 includes a piezoelectric stack 110 and a sensor 96. The sensor 96 may be as known, and senses the distance between an inner surface of one of the seal segments (82/84 in this figure) and an outer periphery (or tip) 180 of an airfoil portion of the blade 80. An electronic engine control 92 communicates with the piezoelectric stack 110 through an electrical power generator 94. The sensor 96 also communicates with the electronic engine control 92 through a generator/controller 98. Notably, the controller 98 may be wireless, and thus not connected by a hardwire to the control 92.

If the sensor 96 senses that the gap is too large, then the actuators 90 are actuated as will be described below. The actuators may also be deactivated to increase the clearance.

Figure 4:
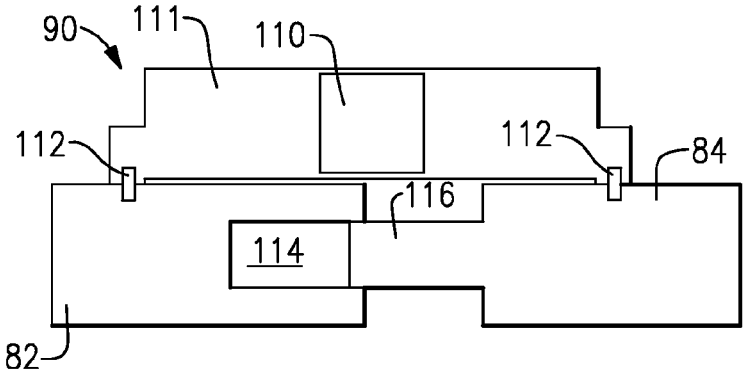
FIG. 4 shows a first portion of an adjustment structure.

As can be seen in FIG. 4, the piezoelectric stack 110 sits within an actuator body 111. The actuator body 111 is anchored or fixed at 112 to each of the blade outer air seal segments 82 and 84. As shown, at one circumferential extent of each of the segments there is a tongue 116, and the tongue is slidably moveable within a groove 114. It should be understood that each of the segments have a tongue at one circumferential end and a groove at the other, and that the four segments thus fit together in a slidable manner.

Figure 5:
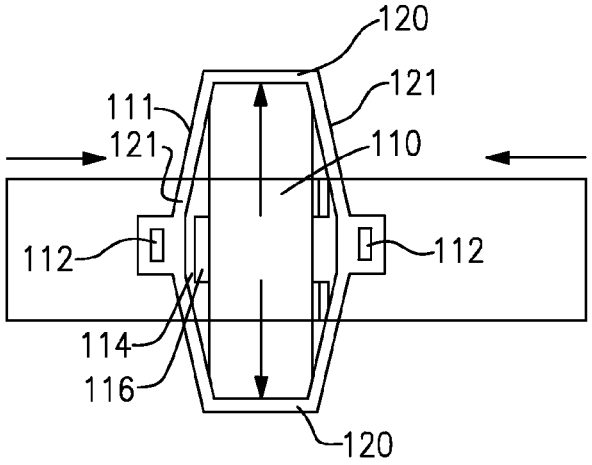
FIG. 5 is a top view of the FIG. 4 structure.

As shown in FIG. 5, the stack 110 can be actuated (or powered, as known) to increase the axial length of the stack 110. As can be appreciated, this increase is generally parallel to a rotational axis of the rotor carrying the blades 80. When this occurs, end caps 120 of the actuator housing 111 stretch, and side arms 121 are pulled toward the stack 110. When this occurs, the tongue 116 is caused to slide circumferentially further into the groove 114, and the inner periphery of the blade outer air seal segments move radially inwardly such that the clearance becomes smaller. On the other hand, if the clearance is too small, the piezoelectric stack 110 can be deactivated such that the side pieces 121 extend further circumferentially away from each other, and such that the segments 82 and 84 can move back radially outwardly. The actuator housing 111 is formed of an appropriate resilient material such that it can return to its original position after actuation.

Figure 6:
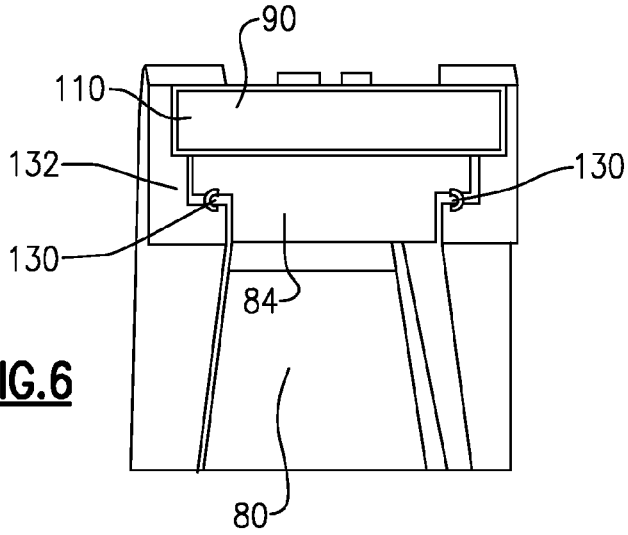
FIG. 6 is a cross-sectional view through the FIG. 4 structure.

FIG. 6 shows a structure including the stack 110 being associated with a blade outer air seal segment 84. As shown, a housing 132 receives this structure. Spring 130 bias the blade outer air seal radially outwardly in opposition to the movement from the piezoelectric stack 110. In this manner, should the actuator 90 fail, the springs 130 would still ensure that there will be sufficient clearance such that the gas turbine engine can continue to operate.

As a result of the ability to adjust the distance between the tips of the blades and the corresponding seal defined by the seal segments, the efficiency of the compressor or turbine rotor can be maintained over a wide variety of operating conditions, thereby enhancing overall engine performance.

While a piezoelectric actuator is shown, other methods of carrying the sliding movement may come within the scope of this application.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gas turbine engine section comprising:

a rotor carrying a plurality of blades, said blades each having a radially outer tip;

a blade outer air seal positioned radially outwardly of said tips of said blades, said blade outer air seal being provided by at least a plurality of circumferentially spaced segments, said circumferentially spaced segments being operable to slide circumferentially relative to each other to adjust an inner diameter of an inner surface of said blade outer air seal segments;

an actuator for actuating said blade outer air seal segments to slide relative to each other to control a clearance between the inner periphery of said blade outer air seal segments and an outer periphery of the tips; and said actuator expands or contracts along an axis generally parallel to a rotational axis of said rotor to in turn cause said blade outer air seal segments to slide circumferentially.

2. The gas turbine engine section as set forth in claim 1, wherein there are at least four of said blade outer air seal segments.

3. The gas turbine engine section as set forth in claim 1, wherein a sensor senses the amount of clearance between the inner periphery of the blade outer air seal segments and the outer periphery of a tip, and communicates to a control for said actuator to control the clearance.

4. The gas turbine engine section as set forth in claim 1, wherein said blade outer air seal segments have a tongue at one circumferential end and a groove at an opposed circumferential end, and the tongue of one of said blade outer air seal segments fits into the groove in an adjacent one of said blade outer air seal segments to guide the blade outer air seal segments for sliding movement.

5. The gas turbine engine section as set forth in claim 4, wherein said actuator includes a piezoelectric stack.

6. The gas turbine engine section as set forth in claim 5, wherein said piezoelectric stack expands or contracts along an axis generally parallel to a rotational axis of said rotor to in turn cause said blade outer air seal segments to slide circumferentially.

7. The gas turbine engine section as set forth in claim 6, wherein a housing for said piezoelectric stack includes segments fixed to each of an adjacent pair of said blade outer air seal segments, and such that when said piezoelectric stack expands or contracts, a circumferential distance between anchor points between said housing and each of said blade outer air seal segments changes to in turn cause said sliding movement of said blade outer air seal segments.

8. The gas turbine engine section as set forth in claim 1, wherein a housing for said actuator includes segments fixed to each of an adjacent pair of said blade outer air seal segments, and such that when said actuator expands or contracts, a circumferential distance between anchor points between said housing and each of said blade outer air seal segments changes to in turn cause said sliding movement of said blade outer air seal segments.

9. The gas turbine engine section as set forth in claim 1, wherein said rotor is a compressor rotor.

10. The gas turbine engine section as set forth in claim 1, wherein said rotor is a turbine rotor.

11. A gas turbine engine comprising:

a compressor section;

a combustor section;

a turbine section;

an actuator; and a blade outer air seal, wherein at least one of said compressor and turbine sections includes at least one rotor carrying a plurality of blades, said blades each having airfoils defining a radially outer tip, wherein the blade outer air seal is positioned radially outwardly of said tips of said blades, said blade outer air seal being provided by at least a plurality of circumferentially spaced segments, said circumferentially spaced segments being operable to slide circumferentially relative to each other to adjust an inner diameter of an inner surface of said blade outer air seal segments, wherein the actuator is configured to actuate said blade outer air seal segments to slide relative to each other to control a clearance between the inner periphery of said blade outer air seal segments and an outer periphery of the tips, and said piezoelectric stack expands or contracts along an axis generally parallel to a rotational axis of said rotor to in turn cause said blade outer air seal segments to slide circumferentially.

12. The gas turbine engine as set forth in claim 11, wherein a sensor senses the amount of clearance between the inner periphery of the blade outer air seal segments and the outer periphery of a tip, and communicates to a control for said actuator to control the clearance.

13. The gas turbine engine as set forth in claim 11, wherein said blade outer air seal segments have a tongue at one circumferential end and a groove at an opposed circumferential end, and the tongue of one of said blade outer air seal segments fits into the groove in an adjacent one of said blade outer air seal segments to guide the blade outer air seal segments for sliding movement.

14. The gas turbine engine as set forth in claim 13, wherein said actuator includes a piezoelectric stack.

15. The gas turbine engine as set forth in claim 13, wherein said actuator expands or contracts along an axis generally parallel to a rotational axis of said rotor to in turn cause said blade outer air seal segments to slide circumferentially, and wherein a housing for said actuator includes segments fixed to each of an adjacent pair of said blade outer air seal segments, and such that when said actuator expands or contracts, a circumferential distance between anchor points between said housing and each of said blade outer air seal segments changes to in turn cause said sliding movement of said blade outer air seal segments.

16. The gas turbine engine as set forth in claim 11, wherein a housing for said piezoelectric stack includes segments fixed to each of an adjacent pair of said blade outer air seal segments, and such that when said piezoelectric stack expands or contracts, a circumferential distance between anchor points between said housing and each of said blade outer air seal segments changes to in turn cause said sliding movement of said blade outer air seal segments.

17. The gas turbine engine as set forth in claim 11, wherein said rotor is a compressor rotor.

18. The gas turbine engine as set forth in claim 11, wherein said rotor is a turbine rotor.

* * * * *